United States Patent [19]

Innes et al.

[11] 4,046,931

[45] Sept. 6, 1977

[54] METHOD AND APPARATUS FOR APPLYING COATING COMPOSITIONS TO STRIP MATERIAL

[75] Inventors: Robert Arthur Innes, Amherstview; Gregory Preston Michael Enright; Garnet Lloyd Derrick, both of Kingston, all of Canada

[73] Assignee: Alcan Research and Development Limited, Montreal, Canada

[21] Appl. No.: 550,750

[22] Filed: Feb. 18, 1975

[30] Foreign Application Priority Data

Feb. 19, 1974 United Kingdom ..... 7611/74

[51] Int. Cl.[2] ..... B05D 1/28

[52] U.S. Cl. ..... 427/428; 118/249; 118/253; 118/255; 118/259; 118/262

[58] Field of Search ..... 427/428; 118/262, 259, 118/249, 253, 255

[56] References Cited

U.S. PATENT DOCUMENTS

| | | | |
|---|---|---|---|
| 2,094,348 | 9/1937 | Carlson | 427/428 |
| 2,556,262 | 6/1951 | Faeber | 427/428 |
| 2,689,196 | 9/1954 | Daniels | 427/428 |
| 2,772,184 | 11/1956 | Wolfe et al. | 427/428 |
| 2,802,752 | 8/1957 | Wood | 427/428 |
| 3,068,119 | 12/1962 | Gotsch | 427/423 |
| 3,158,497 | 11/1964 | Fird et al. | 427/428 |

*Primary Examiner*—Ronald H. Smith
*Assistant Examiner*—Janyce A. Bell
*Attorney, Agent, or Firm*—Cooper, Dunham, Clark, Griffin & Moran

[57] ABSTRACT

A coating material such as a high viscosity, low solvent content paint is applied to metal strip by means of a coater which comprises a soft-covered take-up roll which draws coating material from a reservoir and coacts with a hard metering roll (from which excess coating material is continuously removed by a doctor blade), to form a metered film on the surface of the take-up roll. The metered film is transferred to a small diameter hard transfer roll from which it is in turn transferred to a soft covered applicator roll, by which it is applied to the strip. At each line of contact between two rolls or between the applicator roll and the strip the mutually contacting surfaces travel in opposite directions (i.e., the rolls all rotate in the same sense). Preferably the peripheral speed of the applicator roll is greater than that of the transfer roll, which is greater than that of the take-up roll, but the strip speed is preferably lower than that of the applicator roll.

13 Claims, 1 Drawing Figure

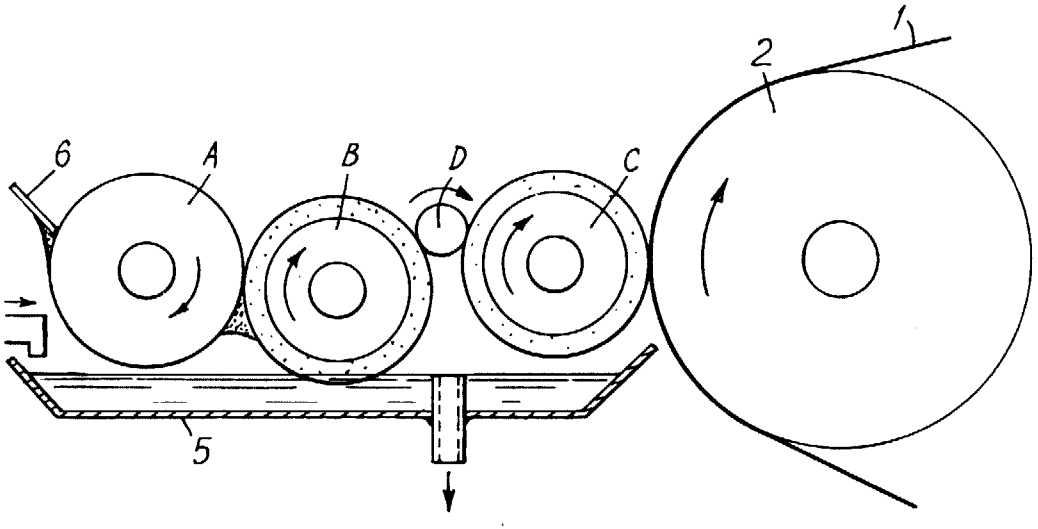
1
2
C
D
B
A
6
5

METHOD AND APPARATUS FOR APPLYING COATING COMPOSITIONS TO STRIP MATERIAL

The present invention relates to the application of coatings to the surface of sheet material, in particular to the surface of metal strip.

It is well known to apply a coating of paint or lacquer to metal strip, which is then stoved to cure the applied coating. The conventional method for applying a coating of such material to a continuous web of metal strip is by means of a roller coater, which includes an applicator roll, having a deformable elastic coating and a relatively hard, usually steel, metering roll, which is loaded against the deformable covering of the applicator roll for the purpose of controlling the thickness of the film of coating medium on the applicator roll for transfer to the moving metal strip. A support roll or stationary support backs the strip at its point of contact with the applicator roll.

In most instances it is preferred that the surface of the applicator roll travels in the reverse direction to the moving strip at the point of contact in order to obtain good transfer of the coating medium from the applicator roll to the surface of the metal strip, although in some instances it is necessary to have the applicator roll run in the same direction as the moving strip in order to obtain a sufficiently thin film of coating medium on the strip.

The quantity of paint passing between two rolls of the character above indicated — that is to say, between a steel roll and a roll with a deformable cover, such as polyurethane or hard synthetic rubber, such as neoprene, is dependent upon the contact force between the applicator roll and the metering roll, amongst other factors. Since the hard roll bites into the surface of the deformable cover to establish a metering gap between the rolls, it will be understood that the width of the gap for metering a film of a particular coating medium will be dependent upon the inter-roll force. The area of contact between a hard roll and a roll having a deformable cover at a given contact loading increases with an increase in the diameter of the hard roll, other factors being maintained at constant value. In the gap between the hard roll and the deformable-covered roll, viscous forces arising from the rotation of the rolls, which increases as the area of contact increases, will tend to force the coating medium between the two rolls. Counteracting this tendency is the contact loading between the rolls. It follows that the roll loading necessary to establish a predetermined flow of coating medium increases with an increase in the diameter of the hard roll and conversely that the flow of coating medium established by a given roll loading decreases with a decrease in the roll diameter. The power requirement required to overcome the viscous forces increases with an increase in roll diameter. It follows that the use of a small diameter hard roll is advantageous.

Reference herein to the relative directions of travel of two rolls refers to the relative directions of the surfaces of the rolls at their line of contact. When two rolls, comprising a first hard-surfaced roll and a second deformable-covered roll, travelling in opposite directions come in contact with a film of coating medium carried on the first roll, part of the film material may be carried through the gap between the rolls and emerges on the outgoing surface of the first roll, whereas another part of the film material is transferred to the outgoing surface of the second roll and thus does not pass through the roll gap. For satisfactory operation, sufficient coating must be carried through the roll gap to lubricate the contacting surfaces. If this condition is not achieved, the deformable rubber coating will alternately stick to and slip over the surface of the hard roll which leads to transverse "chatter marks" in the film. These markings tend to remain in the film.

The paint flow through the gap between two rolls is in the direction of the roll surface with the greater speed. Therefore, to minimize the difficulty associated with stick slip condition, it is necessary that there be sufficient coating on the ingoing surface of the roll with the greater surface velocity.

In most coating operations of the present type it is desirable to operate with a coating composition having as low a content of solvents as possible, since the solvent content of the coating composition is lost to atmosphere unless expensive solvent recovery operations are carried out in conjunction with the coating process; also, the more solvent available for loss to the atmosphere the more expensive are pollution control measures. Reduction in the solvent content of the coating composition leads to increase in viscosity and in consequence to some difference in behaviour at the line of inter-roll contact. Methods of application which permit thin uniform films of high viscosity paints to be applied can lead to important economic advantages.

According to one aspect of the invention, an apparatus for applying a coating material to a metal strip comprises a deformable covered coating take-up roll, means for supplying a coating material to said roll, a hard metering roll in contact therewith to perform a primary metering function on said coating material on said take-up roll, means for removing coating material from the surface of the metering roll at a position remote from its line of contact with the take-up roll, a hard transfer roll in contact with said take-up roll at a point downstream from the line of contact with said metering roll and a deformable-covered applicator roll in contact with said hard transfer roll, said hard transfer roll being of small diameter (no more than 20 cms), and means for rotating all said rolls in the same sense at controllable velocities so that at lines of mutual contact the surfaces of the rolls travel in opposite directions. Although the take-up roll and applicator roll are usually larger than the transfer roll, it is possible for these rolls to be in the range of 10–15 cms diameter, for example where the apparatus is narrow and in consequence roll bending forces are low. In most instances the applicator roll will cooperate with a strip support roll, but where it is desired to coat both surfaces of the strip and to cure both surfaces simultaneously, it is necessary to rely on the strip weight and strip tension to ensure adequate contact between at least one surface of the strip and the applicator roll. Preferably means are provided for rotating at least said metering, transfer and applicator rolls and preferably all said rolls in both senses and at variable rotational velocities to provide maximum flexibility of operation. Preferably the small diameter transfer roll has the minimum practicable diameter which preferably lies in the range of 2.5 – 20 cms, most preferably in the range of 2.5 – 15 cms. The minimum practicable diameter for the small diameter transfer roll depends upon a number of factors.

The criteria which determine a suitable diameter for the small diameter transfer roll are that is shall conform to the following requirements:

i. it must be of large enough diameter to ensure that it has sufficient rigidity to withstand the torsional loads applied to it (and thus its minimum diameter will vary with the width of the apparatus);

ii. it must be large enough to avoid the film being thrown off the roll at the highest contemplated peripheral speed;

iii. subject to satisfying the above conditions the hard roll should be as small as possible for economy both in manufacture and operation, included in the latter being the minimizing of power requirements and roll coating wear costs resulting from lower applied loads being required with a smaller diameter roll to develop the same inter-roll contact pressure as in a larger diameter roll.

In acting as a transfer roll between two deformable-covered rolls, the small diameter roll also permits a secondary metering function to be performed by the latter rolls in that the applicator roll and the other deformable-covered roll can be operated at different relative peripheral speeds, thereby affecting the thickness of film on the applicator roll. The ratio of film thickness on the two deformable-covered rolls is determined by a complex relationship of the ratio of their peripheral speeds and the loading on the rolls. The use of the small diameter transfer roll avoids heavy wear of the roll surfaces or excessive driving force required under some conditions when two deformable-covered rolls are operated in direct contact with one another, that is, without such a transfer roll. The use of the small diameter transfer roll to perform a secondary metering function permits the primary metering function between the first deformable-covered roll and a hard metering roll to be carried out at much lower roll speeds.

In the apparatus of the present invention means are provided as is conventional for applying a variable inter-roll loading. For simplicity the small diameter transfer roll is allowed to float in a direction parallel to the line joining the centres of the two deformable-covered rolls, but is restrained from movement in a direction perpendicular thereto. In consequence, it is found that in practice the inter-roll loading between the small diameter transfer roll and the two deformable-covered rolls should be approximately equal.

A particular advantage of the apparatus of the present invention is that by the use of a small diameter hard transfer roll of, for example, 7 cms diameter, the inter-roll contact area between the transfer roll and the deformable-covered rolls is significantly reduced and this reduces both the power required for driving the deformable-covered rolls and the wear of their covers.

One difficulty that has been experienced with the known two-roll type of coating apparatus is the formation of striations, i.e. closely spaced lines parallel to the direction of strip travel, in the film of coating medium on the metal strip. These striations appear in the film of coating medium on the applicator roll when the surfaces of the applicator roll and metering roll are travelling in the same direction at their point of contact. The striations in the film are carried over from the applicator roll to the metal strip when it is travelling in the reverse direction to the applicator roll. When the applicator roll and the metal strip are travelling in the same direction the striations in the film on the applicator roll are destroyed when the film passes between the roll and the strip but new striations are formed on the strip on the exit side. In either case, these striations may not level out before the coating medium is cured by stoving. Such factors as the solvent, surface tension and rheology of the coating medium determine whether or not unacceptable striations will result from coating operations carried out under specified coating conditions and this fact places a constraint on the formulation of the coating medium and/or on the conditions of operation of the coater.

It has been found that by correct operation of the apparatus of the present invention the formation of striations in the final film on the coated metal strip may be substantially eliminated. This result is achieved by avoiding having the film of coating material passed between two rolls whose surfaces are travelling in the same direction at the point of contact. In the preferred mode of operation this is accomplished by running the metering roll, take-up roll, transfer roll, applicator roll and the strip support roll in the same rotational sense.

One particular advantage of this invention is the ability to meter at lower inter-roll pressures, for a given film thickness. This result is achieved by performing the primary metering at substantially lower roll surface velocities than the surface velocities suitable for application of the coating material to the sheet. Thus the transfer roll is run faster than the take-up roll and the applicator roll is run faster than the transfer roll. Very suitably the peripheral speed of the surface of the take-up roll and the transfer roll is about 40–90% of its succeeding roll. The coating film transferred to the applicator roll is found to be substantially free of striations and in the transfer of this film to the strip it is preferred that the strip speed should be substantially below that of the applicator roll so as to ensure that a substantial proportion of the film shall be carried through the roll gap and thus transferred back to effect lubrication of the contacts between the transfer roll and the applicator roll and the take-up roll. It is, however, found that the metering roll, although it may be operated at a speed of 0–90% of the speed of the take-up roll, is most preferably operated at a speed of from nearly 0 up to 20% of the speed of the take-up roll.

According to another aspect of the present invention a method of applying a film of a coating material to a moving metal strip comprises taking up a continuous film of coating material on a rotating first deformable-covered roll, contacting said first deformable-covered roll with a hard roll travelling in the opposite direction to form a metered film on the surface of said first deformable-covered roll, continuously removing coating material from the surface of said hard roll, contacting the surface of said deformable-covered roll, carrying said metered film, with a small diameter hard transfer roll travelling in the opposite direction to transfer coating material to said hard transfer roll, contacting said hard transfer roll with a second deformable-covered roll travelling in the opposite direction to said hard transfer roll to transfer coating material to said second deformable-covered roll, and then transferring said coating material from said second deformable-covered roll to moving strip metal by contacting said second deformable-covered roll with a strip travelling in opposite direction thereto, said method including rotating said hard transfer roll at a peripheral speed greater than said first deformable-covered roll, rotating said second deformable-covered roll at a peripheral speed greater than said transfer roll. In this method the strip speed is preferably substantially less than, for example 30–70% less than, the peripheral speed of the applicator roll.

A preferred form of coating apparatus is illustrated in the accompanying FIG. 1. The apparatus comprises a rubber-covered applicator roll C, by means of which the coating composition is applied to a strip 1, on a support roll 2, travelling in a reverse direction to the applicator roll C. The paint or other coating composition is transferred to the applicator roll C by means of a small diameter steel roll D from a rubber-covered take-up roll B. The thickness of the film of coating composition on the roll B is determined by interaction of roll B with a steel metering roll A. In the preferred construction of the apparatus rolls A, B, C and D are all provided with reversible drives and may be rotated at speeds which are independent of the speeds of the other rolls of the apparatus, so that any combination of speeds and directions of rolls A, B, C and D may be selected.

In a preferred mode of operation the roll A is driven in the reverse direction to roll B in performance of the metering function, with a doctor 6 removing all paint reaching that location on the surface of roll A. The roll A performs a levelling function on the metered coating film on roll B downstream of the roll bite between rolls A and B. The roll B picks up paint (or other coating composition) from tray 5 to which a continuous supply is maintained.

In one example of operation the apparatus illustrated in the accompanying drawing was employed to coat aluminum strip with a high gloss polyester paint having a viscosity of 960 centipoises.

The following table sets out the roll diameters, peripheral velocity and inter-roll forces (roll D floating between rolls B and C, as previously mentioned).

| | Diameter (in. -cm.) | | Roll Velocity | | Inter-Roll Forces | |
|---|---|---|---|---|---|---|
| Roll | ins. | cms. | f.p.m. | cm/sec. | (lb./in.) | Kg/cm |
| A | 10 | 25 | 20 | 10 | A-B 60 | 11 |
| B | 11.5 | 30 | 300 | 150 | B-C 20 | 3.6 |
| C | 11.5 | 30 | 620 | 310 | | |
| D | 2.8 | 7 | 440 | 220 | C 30 | 5.5 |
| Strip' | | | 300 | 150 | Strip | |

This resulted in a dry film thickness of 12½ microns with excellent surface appearance. With this paint it is very difficult on a conventional coater to obtain a film as thin as 20 microns without the addition of considerable extra solvent and even then the surface appearance is inferior to that produced by the coater of the present invention.

What is claimed is:

1. An apparatus for applying a coating material to a metal strip comprising a deformable-covered coating take-up roll, means for supplying a coating material to said roll, a hard metering roll in contact therewith to perform a primary metering function on said coating material on said take-up roll, means for removing coating material from the surface of the metering roll at a position remote from its line of contact with the take-up roll, a hard transfer roll in contact with said take-up roll at a point downstream from the line of contact with said metering roll and a deformable-covered applicator roll in contact with said hard transfer roll, said hard transfer roll being of small diameter and means for rotating all said rolls in the same sense at controllable velocities so that at lines of mutual contact the surfaces of the rolls travel in opposite directions with said hard transfer roll rotating at a peripheral speed greater than that of said take-up roll and said applicator roll rotating at a peripheral speed greater than that of said transfer roll; said supplying means comprising means for bringing said coating material into contact with the surface of said take-up roll at a locality spaced from the line of contact of said transfer roll with said take-up roll; and said metering roll being disposed for contact with said take-up roll along a line between said last-mentioned locality and the line of contact of said transfer roll with said take-up roll in the direction of surface travel of said take-up roll.

2. An apparatus according to claim 1 in which the small diameter transfer roll has a diameter in the range of 2.5–15 cms.

3. An apparatus according to claim 1 in which the small diameter transfer roll is of smaller diameter than said take-up roll and said applicator roll.

4. An apparatus according to claim 1, further characterised by means for driving said metering roll, said transfer roll and said applicator roll in both senses and variable speeds.

5. An apparatus according to claim 1 in which said transfer roll is floatingly mounted between said take-up roll and said applicator roll.

6. A method of applying a film of a coating material to a moving metal strip comprising taking up a continuous film of coating material on a rotating first deformable-covered roll, contacting said first deformable-covered roll with a hard roll having its surface travelling in the opposite direction thereto at the line of contact with said first deformable-covered roll to form a metered film on the surface of said first deformable-covered roll, continuously removing coating material from the surface of said hard roll, contacting the surface of said first deformable-covered roll, carrying said metered film, with a small diameter hard transfer roll having its surface travelling in the opposite direction thereto at the line of contact with said first deformable-covered roll to transfer coating material to said hard transfer roll, contacting said hard transfer roll with a second deformable-covered roll having its surface travelling in the opposite direction thereto at the line of contact with said hard transfer roll to transfer coating material to said second deformable-covered roll, and then transferring said coating material from said second deformable-covered roll to moving strip metal by contacting said second deformable-covered roll with a strip travelling in opposite direction thereto at the line of contact with said second deformable-covered roll, said method including rotating said hard transfer roll at a peripheral speed greater than said first deformable-covered roll, and rotating said second deformable-covered roll at a peripheral speed greater than said transfer roll; the step of taking up coating material comprising bringing said coating material into contact with the surface of the first deformable-covered roll at a locality spaced from the line of contact of the first deformable-covered roll with said hard transfer roll, and said first-mentioned hard roll being disposed for contact with said first deformable-covered roll along a line between said last-mentioned locality and the line of contact of said hard transfer roll with said first deformable-covered roll in the direction of surface travel of said first deformable-covered roll.

7. A method according to claim 6 in which the peripheral speed of said first deformable-covered roll is 40–90% of the peripheral speed of said transfer roll.

8. A method according to claim 6 in which the peripheral speed of said transfer roll is 40–90% of the peripheral speed of said second deformable-covered roll.

9. A method according to claim 6, in which the loading of the second deformable-covered roll against the strip and the relation of the strip speed and the peripheral speed of the second deformable-covered roll are arranged so that the second deformable-covered roll carries a substantial film of coating material through the bite between said roll and said strip.

10. A method according to claim 6 in which the peripheral speed of the first-mentioned hard roll is not more than 20 percent of the peripheral speed of the first deformable-covered roll.

11. A method according to claim 6 in which the strip speed is substantially less than the peripheral velocity of said second deformable-covered roll.

12. A method according to claim 6 in which the loading of said first deformable-covered roll against said transfer roll is substantially equal to the loading of said second deformable-covered roll against said transfer roll.

13. A method according to claim 6 in which the diameter of said transfer roll is in the range of 2.5 – 15 cms.

* * * * *